United States Patent [19]

Chiarenza

[11] 4,327,610

[45] May 4, 1982

[54] OPEN END RATCHET WRENCH

[76] Inventor: Angelo Chiarenza, 393 Sunrise Hwy., West Babylon, N.Y. 11704

[21] Appl. No.: 155,449

[22] Filed: Jun. 2, 1980

[51] Int. Cl.[3] ..... B25B 13/52

[52] U.S. Cl. ..... 81/64; 81/91 R; 81/477

[58] Field of Search ..... 81/64, 91, 180 B, 472, 81/477, 478, 125; 192/46

[56] References Cited

U.S. PATENT DOCUMENTS 2,697,371 12/1954 Bowman ..... 81/125.1

2,838,270 6/1958 Danielson ..... 192/46

3,655,065 10/1953 Murphy ..... 81/64

3,906,822 9/1975 Hertelendy et al. ..... 81/91 R

*Primary Examiner*—James L. Jones, Jr.

*Attorney, Agent, or Firm*—Bernard Malina

[57] ABSTRACT

An open end ratchet wrench has a head portion which includes a slot into which a plurality of cantilever spring segments project. The ends of the cantilever spring segments engage and turn the flat surfaces of a nut when the wrench is turned in a tightening direction. When the wrench is turned in the opposite direction, the cantilever springs flex to override the corners of the nut and then spring back to engage adjacent flat surfaces of the nut.

8 Claims, 7 Drawing Figures

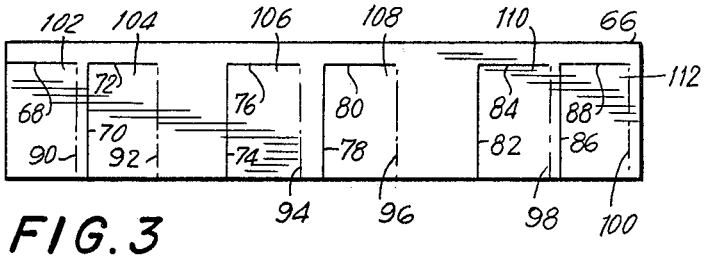
FIG. 3
FIG. 1
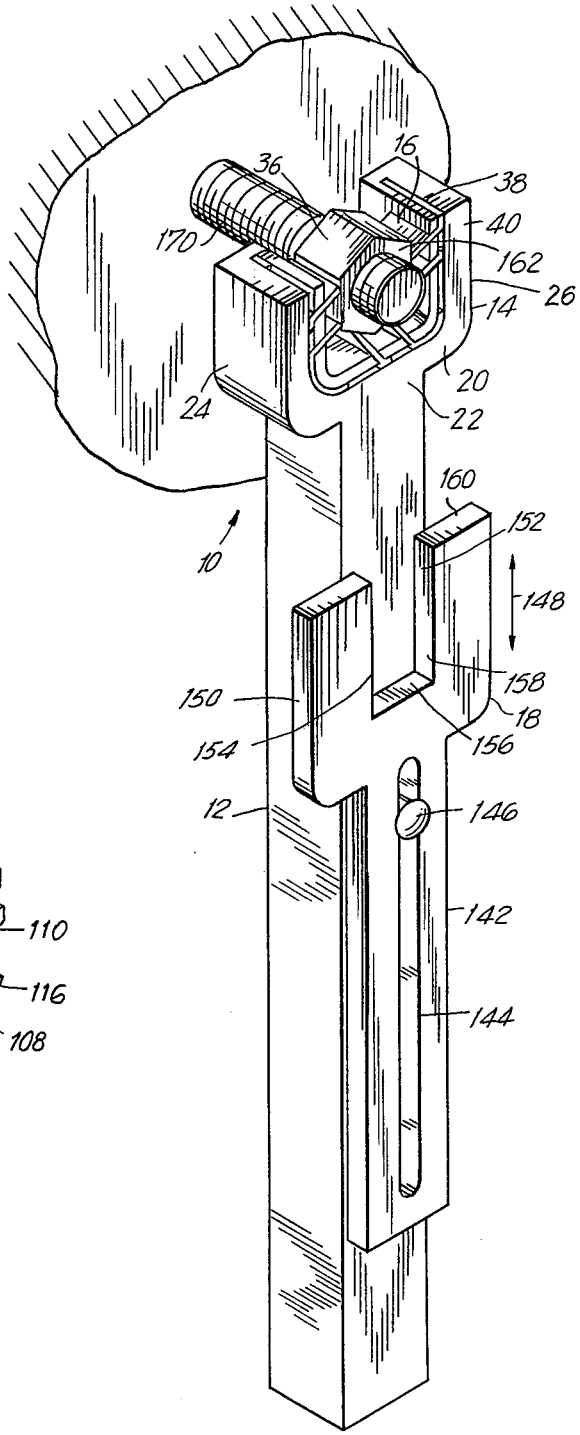
FIG. 2
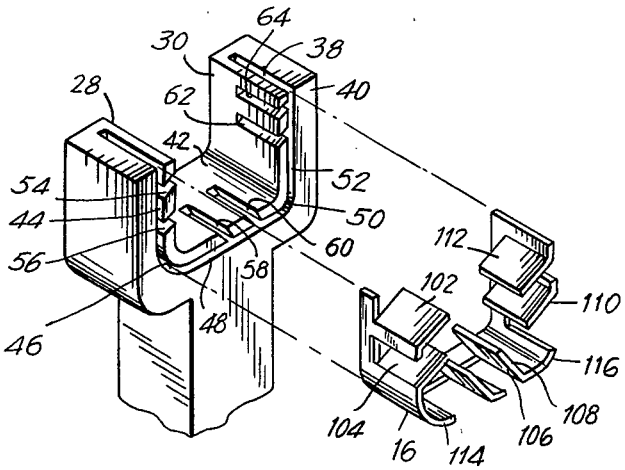

FIG. 4
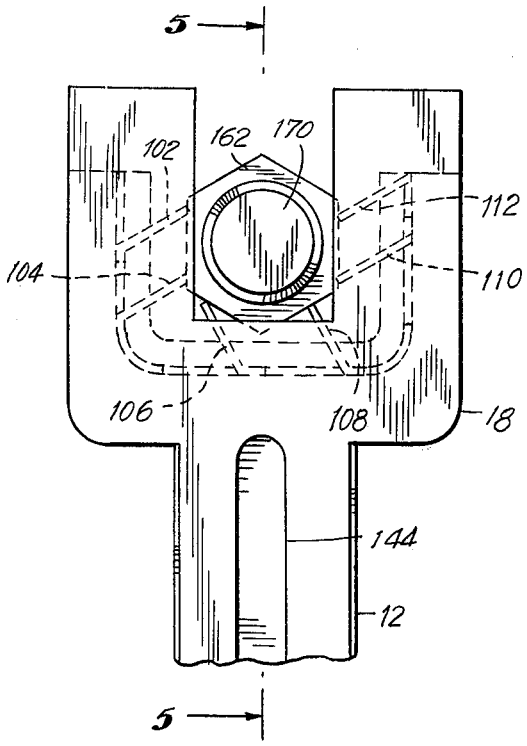
FIG. 5
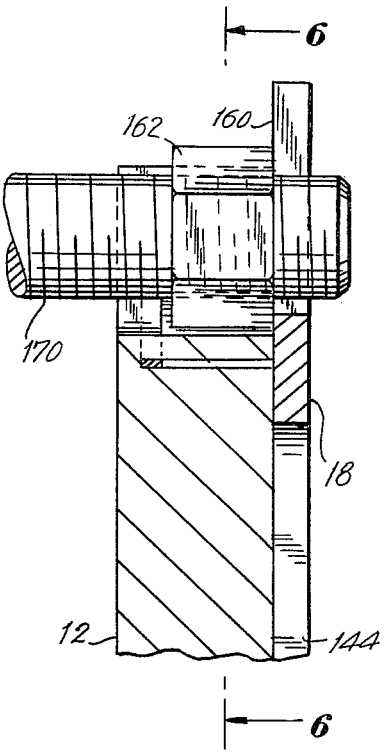
FIG. 6
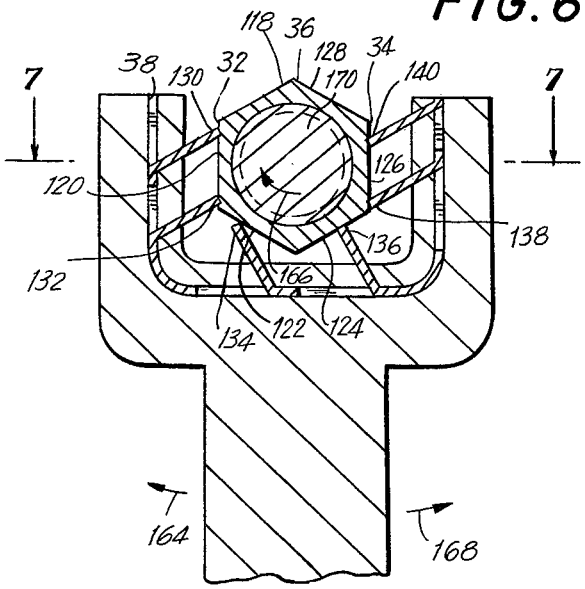
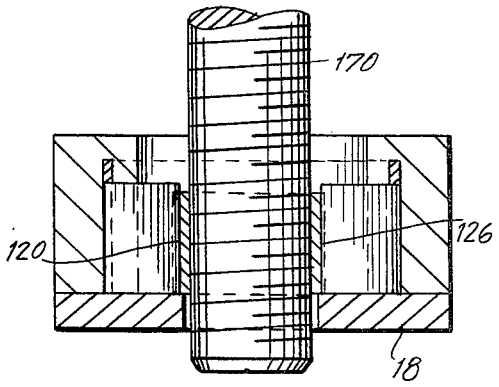
FIG. 7

OPEN END RATCHET WRENCH

BACKGROUND OF THE INVENTION

Current trends in the design of machinery and equipment are directed toward a provision of smaller, lighter and less costly configurations. Unfortunately these trends also result in a reduction of the space available for tool access. Conventional socket tools which comprise a set of various sizes of sockets and a ratchet drive tool often cannot be used on such equipment because of limited space. This problem coupled with the ever increasing cost of labor contributes to a long felt need for a practical and efficient open end ratchet wrench tool.

The prior art includes numerous attempts to provide a practical open end ratchet wrench. The prior art devices are all characterized by a reliance on pawls, cams, spring loaded members and similar individual mechanical elements to provide a mechanism capable of a ratcheting or overriding motion. This results in a requirement for a relatively large number of individual component parts in any single ratchet tool and consequently, a high manufacturing cost. In addition, the relatively close tolerances which these component parts require for operation results in a relatively high rate of malfunction due to damage caused by dropping and other types of mishandling often encountered during normal tool use.

OBJECTS OF THE INVENTION

It is an object of the invention to provide a practical open end ratchet wrench which has an extremely limited number of relatively simple component parts.

Another object of the present invention is to provide an open end ratchet wrench which does not rely on close tolerance component parts for operation.

Another object of the present invention is to provide an open end ratchet wrench which utilizes a relatively simple operating member.

Another object of the present invention is to provide an open end ratchet wrench which cannot be rendered inoperative by dirt particles, metal chips or wear of component elements.

Another object of the present invention is to provide an open end ratchet wrench which can be manufactured easily using high volume production equipment.

Still another object of the present invention is to provide an open end ratchet wrench which is extremely economical of manufacture in a relatively low unit cost.

SUMMARY OF THE INVENTION

In accordance with the present invention there is provided an open end ratchet wrench which has a head portion mounted on a handle member. The head portion has a plurality of cantilever spring segments which are angularly disposed within a slot opening which is formed in the head portion. The angular orientation of the segments is such that when the device is engaged on a nut and the handle portion is rotated, at least two of the segments are placed into compression by the faces of the nut and the tongue of the handle is transmitted to the nut causing it to turn. When the handle is rotated in the opposite direction, the forces on the segments causes the segments to flex and override the corners of the nut after which they spring back to their original position and engage faces of the nut which are adjacent to the faces originally engaged. This provides a ratcheting action which enables the nut to be rotated in a tightening direction, the handle then moved to a new position and the nut again rotated further in a tightening direction.

Additional objects and advantages of the present invention will become more apparent during the course of the following specification when taken in connection with the accompanying drawings in which:

BRIEF DESCRIPTION OF THE DRAWINGS

FIG. 1 is an overall perspective view of an open end ratchet wrench made in accordance with the present invention, with the device shown in use;

FIG. 2 is an exploded view of the head portion of the open end ratchet wrench of FIG. 1;

FIG. 3 is a plan view of a piece of blank stock prior to the forming operations which result in fabrication of the insert member shown in FIG. 2, with the lines along which the stock is to be cut shown as solid lines and the lines along which the stock is to be bent shown as broken lines;

FIG. 4 is a partial front elevation view of the open end ratchet wrench shown in use, with the sliding stop member shown in the engaged position;

FIG. 5 is a longitudinal sectional view taken along the line 5—5 of FIG. 4;

FIG. 6 is another longitudianl sectional view taken along the line 6.6 of FIG. 5, and FIG. 7 is a transverse sectional view taken along the line 7–7 of FIG. 6.

DETAILED DESCRIPTION OF THE PREFERRED EMBODIMENT

With reference to the drawings there is shown in FIG. 1 an open end ratchet wrench 10, made in accordance with the present invention, which comprises a handle portion 12, a head portion 14, an insert portion 16 and a slidably mounted stop member 18.

The head portion 14 includes a transverse base portion 20 which is integral with an upper end 22 of the handle portion 12. A pair of integrally formed and spaced apart arm portions 24, 26 project from the loose portion 20. The head portion 14 as thus far described resembles, in overall configuration, a conventional open end wrench with the exception that the distance between the inside surfaces 28, 30 of the arms 24, 26 is greater than the distance between the parallel flat surfaces 32, 34 of the nut 36 which is to be turned. This difference facilitates the operation of the insert member 16 which is to be presently described and which forms a major novel feature of the present invention.

The head portion 14 includes a milled slot 38 formed in the surface 40 which follows and is generally parallel to the inner surfaces 28, 30 42 of the head portion 14. The slot 38 comprises a first straight portion 44 parallel to the surface 28 which communicates with a curved portion 46, a second straight portion 48 which communicates with the curved portion 46, and with a second curved portion 50. A third straight portion 52 of the slot 38 communicates with the second curved portion 50 and is parallel to the surface 30. A series of six slots 54, 56, 58, 60, 62, 64 each somewhat shorter in depth than the slot 38 each pierce the surfaces 28, 30, 42 and communicate with the opening defined by the surfaces 28, 30, 42, as will be presently described. The slots 54, 56 pierce the surface 28 and slope upward to right when viewed from the open end of the slot 38 as in FIGS. 1, 2, 4 and 6. Whe similarly viewed, the slots 58, 60 pierce the surface 42 and slope upward to the left and the slots 62, 64 pierce the surface 30 and slope downward to the left.

The insert member 16 fits into the slot and is best shown in FIG. 2. The insert member 16 is formed from a rectangular piece of blank stock 66 which is shown in its initial configuration in FIG. 3. The blank stock 66 is pierced or cut along the solid lines 68, 70, 72, 74, 76, 78, 80, 82, 84, 86, 88 and then bent along the broken lines 90, 92, 94, 96, 98, 100. The sections 102, 104, 106, 108, 110, 112 are bent upward from the plane of the blank stock 66 forming an angle which is in the order of approximately 60 degrees. Curved portions 114, 116 are then formed in blank stock 66 to conform with the curved portions 46, 50 of the slot 38.

The insert member 16 is inserted in the slot 38 as is shown in FIG. 1. The sections 102, 104, 106, 108, 112, 114 pass through the slots 54, 56, 58, 60, 62, 64 respectively and project into the open area defined by the surfaces 28, 30, 42. The sections 102, 104, 106, 108, 112, 114 are proportioned so that the outer ends of the sections touch the flat surfaces 118, 120, 122, 124, 126, 128 of the nut 36 with the ends 130, 132 touching the flat surface 120, the end 134 touching the flat surface 122 and the end 136 touching the flat surface 124 and the ends 138, 140 touching the surface 126.

The insert member 16 is made of a spring steel which has the temper and resiliency to enable the sections 102, 104, 106, 108, 110, 112 to bend in the manner of cantilever springs during operation of the open end ratchet wrench 10 and then spring back to the position shown in FIG. 6.

The stop member 18, which is slidably mounted on the handle portion 12, has a handle portion 142 which is somewhat narrower than the handle portion 12 and which includes a slot 144. A rivet 146 passes through the slot 144 and slidably attaches the two handle portions 12, 142 and permits relative motion of the handle portion 142 in the direction shown by the arrow 148 in FIG. 1. The stop member 18 includes a head portion 150 which includes a slot 152 formed by the surfaces 154, 156, 158. The slot 152 generally resembles the wrench slot of a conventional open ended wrench with the exception that the distance between the parallel surfaces 154, 158 is just slightly less than the distance between the parallel flat surfaces 120, 126 of the nut 36, and when in the fully extended position, the lower surface 160 of the stop member 18 partially overlies the top surface of the nut 36 on which the open end ratchet wrench 10 is engaged as is best shown in FIG. 4.

When the stop member 18 is in the fully extended position it prevents the open end ratchet wrench 10 from sliding past the nut 36. The stop member 18 facilitates engaging the open end ratchet wrench 10 on to a nut even when the nut is overhead or in an otherwise awkward position.

During operation of the open end ratchet wrench 10 to tighten a nut, the stop member 10 may be moved downward so that the head portion of the stop member 18 is free of the head portion as is shown in FIG. 1. The head portion 14 is placed on the nut 36 so that the ends 130, 132, 134, 136, 138, 140 of the sections 102, 104, 106, 108, 110, 112 engage the flat surfaces 120, 122, 124, 126 of the nut 36 as is shown in FIGS. 1 and 6. The handle portion 12 is turned in a conventional manner to tighten the nut 36 with the motion of the handle portion 12 being indicated by the arrow 164 in FIG. 6. The force exerted on the sections 102, 110 at this time is nearly parallel to the plane of these sections placing these sections into a state of stress which has a relatively high component of compression and these sections force the nut 36 to rotate in the direction shown by the arrow 166 in FIG. 6. As the nut 36 rotates the ends 130, 132, 134, 136, 138, 140 of the sections 102, 104, 106, 108, 110, 112 maintain the position of the open end ratchet wrench 10 with respect to the nut 36. When handle portion 12 can no longer be moved in the direction shown by the arrow 164 in FIG. 6, either because of limited tool access in a given area, or because of operation convenience, the ratchet action of the open end ratchet wrench 10 is utilized.

During this ratchet action, the handle 12 is moved in the direction shown by the arrow 168 in FIG. 6. At this time there is sufficient friction between the threads of the nut 36 and the threads of the stud 170 so that the nut 36 does not move or at most moves very slightly. Moving the handle portion 12 in the direction shown by the arrow 168 causes the flat surfaces 120, 122, 124, 126 of the nut 36 to exert forces on the sections 102, 104, 106, 108, 110, 112 which are at an angle to or in some cases, generally perpendicular to the planes of each of these sections. This places these sections into a state of bending stress and causes them to flex like cantilever springs thereby overriding the corners of the nut establishing a new position with the sections each engaging a new flat which is adjacent to the flat previously engaged. This new position may be further described by indicating that in the new position the ends 130, 132 engage the flat 122, the end 134 engages the flat 124, the end 136 engages the flat 126, and the ends 138, 140 engage the flat 128. The handle position 12 may be again moved in the direction shown by the arrow 168 to again move the sections to the next adjacent flats as desired. When the desired position of the handle portion 12 is reached, the nut 36 is again tightened by turning the handle portion 12 in the direction shown by the arrow 164. In a manner similar to that previously described, the sections 102 and 110 turn the nut in the direction shown by the arrow 166.

During the action of overridding the corners of the nut the instantaneous positions of the ends of the sections may be described as follows: the ends 130, 132 move closer to the surface 28, the ends 134, 136 move closer to the surface 42 and the ends 138, 149 move closer to the surface 30. Once past these corners the sections spring back to their straight unflexed positions as is best shown in FIG. 6 and again engage the new flat portions of the nut as has been previously described.

If it is desired to loosen a nut rather than tighten a nut, the open end ratchet wrench is inverted, with the slot 38 facing in the opposite direction, to that shown in FIG. 1 and the open end wrench is engaged on the nut and is operated in a manner similar to that which has been described.

While a preferred embodiment of the invention has been shown and described herein it is obvious that numerous omissions, changes and additions may be made in such embodiment without departing from the spirit and the scope of the invention.

What is claimed is:

1. An open end ratchet wrench comprising a handle member and a head portion, disposed on said handle member and having a slot opening and a plurality of flexing means mounted on said head member and projecting into said slot opening, with said flexing means each capable of transmitting force along a first direction and capable of flexing when force is applied in a second direction, for the purpose of engaging and turning a nut with forces along said first direction and then flexing to override the corners of the nut thereby creating a ratchet action, said plurality of flexing members comprising a plurality of cantilever spring members mounted on a common member which is mounted on said head portion.

2. An open end ratchet wrench according to claim 1 further comprising a stop member slidably mounted on said handle member and comprising an operating portion having a slot opening, in general alignment with said slot opening in said head portion, for the purposes of overlying said nut and facilitating engaging said open end wrench on said nut.

3. An open end ratchet wrench according to claim 1 in which said cantilever spring members are rectangular.

4. An open end ratchet wrench according to claim 1 in which said cantilever springs are respectively mounted at an acute angle with said head portion.

5. An open end ratchet wrench according to claim 4 in which said plurality of cantilever springs are each mounted at an angle in the order of approximately sixty degrees with respect to said head portion.

6. An open end ratchet wrench according to claim 1 in which said slot opening is defined by a pair of parallel walls each adjoining a wall disposed perpendicular to said parallel walls and in which each of said cantilever spring members has a first end mounted on said head portion and a second end projecting into said slot.

7. An open end ratchet wrench comprising a handle member and a head portion, disposed on said handle member and having a slot opening and a plurality of flexing means mounted on said head member and projecting into said slot opening, with said flexing means each capable of transmitting force along a first direction and capable of flexing when force is applied in a second direction, for the purpose of engaging and turning a nut with forces along said first direction and then flexing to override the corners of the nut thereby creating a ratchet action, said plurality of flexing members comprising a plurality of cantilever spring segments integrally formed on a strip member which is mounted on said head portion.

8. An open end ratchet wrench according to claim 7 in which said head portion includes a slot portion adjacent to said opening and a plurality of slots each communicating with said slot opening and said slot portion and with said strip member is disposed in said slot portions and with said cantilever spring segments projecting, one each, through said plurality of slots and into said slot opening.

* * * * *